US006704535B2

(12) United States Patent
Kobayashi et al.

(10) Patent No.: US 6,704,535 B2
(45) **Date of Patent: *Mar. 9, 2004**

(54) FIBER-REINFORCED INTERMEDIATE TRANSFER MEMBER FOR ELECTROPHOTOGRAPHY, AND ELECTROPHOTOGRAPHIC APPARATUS INCLUDING SAME

(75) Inventors: Hiroyuki Kobayashi, Fuji (JP); Akihiko Nakazawa, Kanagawa-ken (JP); Atsushi Tanaka, Susono (JP); Tsunenori Ashibe, Yokohama (JP); Takashi Kusaba, Shizuoka-ken (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/777,607

(22) Filed: Dec. 31, 1996

(65) Prior Publication Data

US 2002/0159799 A1 Oct. 31, 2002

(30) Foreign Application Priority Data

Jan. 10, 1996 (JP) ..... 8-002162
Jan. 10, 1996 (JP) ..... 8-002165

(51) Int. Cl.[7] ..... G03G 15/16
(52) U.S. Cl. ..... 399/308; 399/302
(58) Field of Search ..... 399/308, 121, 399/297, 302; 430/48, 56, 126

(56) References Cited

U.S. PATENT DOCUMENTS

| | | | | | |
|---|---|---|---|---|---|
| 3,899,622 | A | * | 8/1975 | Geiger | 442/23 |
| 4,856,502 | A | * | 8/1989 | Ersfeld | 128/90 |
| 5,409,557 | A | | 4/1995 | Mammino et al. | 156/137 |
| 5,736,465 | A | * | 4/1998 | Stahl et al. | 428/298 |
| 5,754,931 | A | * | 5/1998 | Castelli et al. | 399/297 |
| 5,995,793 | A | * | 11/1999 | Enomoto et al. | 399/302 |
| 5,995,794 | A | * | 11/1999 | Osada et al. | 399/302 |

FOREIGN PATENT DOCUMENTS

| | | | |
|---|---|---|---|
| JP | 59-77467 | * | 5/1984 |
| JP | 62293270 | | 12/1987 |
| JP | 63-100477 | * | 5/1988 |
| JP | 63301960 | | 12/1988 |
| JP | 03069166 | | 3/1991 |
| JP | 03-293385 | | 12/1991 |
| JP | 03293385 | | 12/1991 |
| JP | 3-293385 | * | 12/1991 |
| JP | 04-115278 | | 4/1992 |
| JP | 06149079 | | 5/1994 |
| KR | 95-00910 | * | 2/1995 |

* cited by examiner

*Primary Examiner*—Quana M. Grainger
(74) *Attorney, Agent, or Firm*—Fitzpatrick, Cella, Harper & Scinto

(57) ABSTRACT

An intermediate transfer member suitable for full-color image formation by electrophotography is formed by an elastic base layer and a fibrous core member embedded with the base layer. The core member is formed of fibers which are disposed within the base layer at a spacing between adjacent fibers of 50–3000 μm. As a result, the intermediate transfer member is reinforced to exhibit improved superposed transfer performance free from color deviation while retaining good transfer performance.

13 Claims, 5 Drawing Sheets

FIBER-REINFORCED INTERMEDIATE TRANSFER MEMBER FOR ELECTROPHOTOGRAPHY, AND ELECTROPHOTOGRAPHIC APPARATUS INCLUDING SAME

FIELD OF THE INVENTION AND RELATED ARTS

The present invention relates to an intermediate transfer member for temporarily holding an image in an image forming process according to electrophotography, and an electrophotographic apparatus including the intermediate transfer member.

An electrophotographic apparatus including an intermediate transfer member is very effective for forming a color image by sequentially superposing and transferring a plurality of component color images. For example, it is possible to decrease color deviation in superposing respective color toner images compared with a transfer process described in Japanese Laid-Open Patent Application (JP-A) 63-301960. Moreover, it is possible to transfer an image from the intermediate transfer member onto a recording medium or transfer-receiving material without necessitating holding means, such as glipper means, sucking means or curvature means (as disclosed in FIG. 1 of JP-A 63-301960), so that the recording medium can be selected from a wide variety of materials, including thin paper (40 g/m$^2$) to thick paper (200 g/m$^2$), wide to narrow medium, and long to short medium. Accordingly, transfer can be performed onto an envelope, a post card and even label paper, etc.

Because of such advantageous features, color copying machines and color printers using intermediate transfer members have already been available on the market.

The intermediate transfer member may assume a shape of a drum or a belt, and a belt-shaped intermediate transfer member is advantageous because it allows a reduction in entire apparatus cost and a broad latitude for disposition designing thereof.

However, a conventional intermediate transfer belt comprising resin or rubber has caused the following difficulties when supported under tension about a roller.

(1) The permanent elongation of the intermediate transfer belt is gradually increased until the belt slips on the roller so that a deviation (color deviation) is caused between respective color toner images when the toner images are transferred from the photosensitive member onto the intermediate transfer belt (primary transfer), thus failing to provide clear images.

(2) When the belt is biased on the roller to its side, the belt edge is abutted against the flange, etc., to be rubbed and damaged in some cases.

Against these problems, e.g., JP-A 3-293385 has proposed to reinforce a rubber-made intermediate transfer belt with backing polyamide woven cloth. In this case, however, as there is a large difference in electrical resistivity between the rubber and the woven cloth, the intermediate transfer belt is caused to have a very large thicknesswise resistivity depending on the material and the thickness of the woven cloth, thus failing to effect good electrostatic transfer. Further, the trace of the woven cloth can appear in the product image, preventing high-quality images.

On the other hand, JP-A 6-149079 discloses an intermediate transfer belt comprising PVDF or polycarbonate, but the belt lacks elasticity by itself, so that transfer failure such as hollow image dropout (i.e., middle image portion surrounded by a contour of image being not transferred) is liable to occur, and the belt is liable to be torn or cracked due to resin fatigue under repetitive use, thus involving problems regarding durability.

In addition to the above, U.S. Pat. No. 5,409,557, JP-A 62-293270, JP-A 3-293385 and JP-A 3-69166 have disclosed reinforcement of intermediate transfer belts with fiber, etc.

Accordingly, we have made various intermediate transfer belts of rubbery elastic material reinforced with fiber. As a result, we have discovered the occurrence of a new-type of difficulty (hereinafter called "core trace image") that the fiber trace appears as a density irregularity in a product image in some cases.

SUMMARY OF THE INVENTION

An object of the present invention is to provide an intermediate transfer member which is free from permanent elongation even in repetitive use, excellent in durability and free from the occurrence of core trace image.

Another object of the present invention is to provide an electrophotographic apparatus including such an intermediate transfer member and capable of providing clear images free from color deviation or core trace image.

As a result of our study, it has been discovered that the above-mentioned core trace image has occurred in the case where the fibers constituting the core member embedded within the base layer of the intermediate transfer member are not disposed with a proper spacing between adjacent fibers.

According to the present invention accomplished based on the above finding and further study, there is provided an intermediate transfer member comprising a base layer, and a core member embedded within the base layer and comprising fibers disposed with a spacing of 50–300 $\mu$m between adjacent fibers.

According to the present invention, there is further provided an electrophotographic apparatus, comprising:

an electrophotographic photosensitive member, charging means for charging the electrophotographic photosensitive member, imagewise exposure means for exposing imagewise the charged electrophotographic photosensitive member to form an electrostatic image, developing means for developing the electrostatic image to form a toner image on the electrophotographic photosensitive member, and an intermediate transfer member for temporarily receiving the toner image by transfer from the electrophotographic photosensitive member, wherein the intermediate transfer member comprising a base layer, and a core member embedded within the base layer and comprising fibers disposed with a spacing of 50–300 $\mu$m between adjacent fibers.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, the intermediate transfer member according to the present invention will be described with respect to some embodiments in the form of a belt but need not be restricted to such a belt form.

Figure 1:
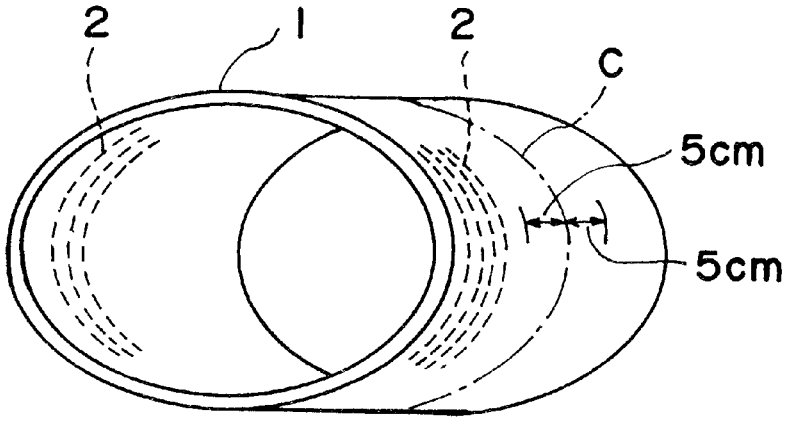
FIG. 1 is a perspective view for illustrating an embodiment of the intermediate transfer member according to the invention.
Figure 2:
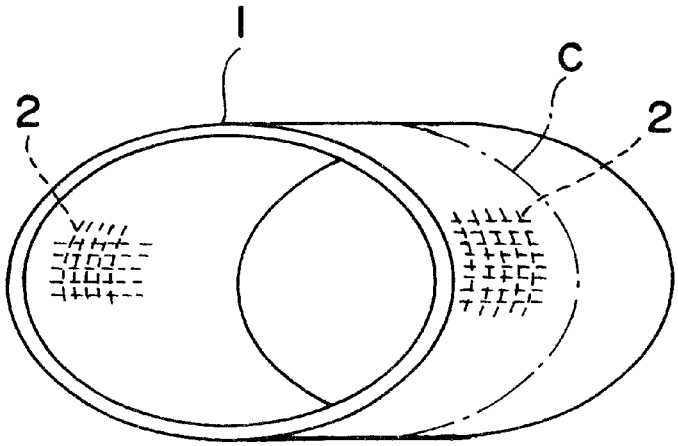
FIG. 2 is a perspective view for illustrating another embodiment of the intermediate transfer member according to the invention.

FIG. 1 is a perspective illustration of an embodiment of the intermediate transfer member according to the present invention. Referring to FIG. 1, the intermediate transfer member comprises a base layer 1 and a core member 2 embedded within the base layer 1. The base layer 1 may comprise an elastic material, such as a rubber or elastomer, or resin. The core member 2 may comprise fibers in the form of a spiral, rings or woven cloth (or textile) as shown in FIG. 2. In view of the easiness of production and cost, it is preferred to embed fibers in the form of a spiral or a woven cloth within the base layer 1.

By embedding the core member 2 within the base layer 1, it becomes possible to provide an intermediate transfer member free from permanent elongation and having excellent durability.

Figure 3:
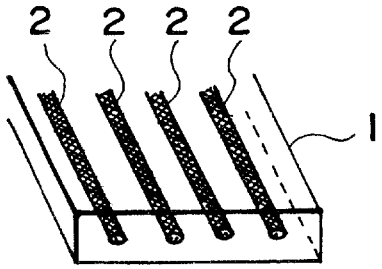
FIGS. 3 and 5 are partial internal oblique views each illustrating an example of core member embedded within an intermediate transfer member according to the invention.

In the case of embedding fibers in the form of a spiral within the base layer 1, adjacent fibers 2 within the base layer are disposed substantially parallel to each other as shown in FIG. 3.

In the intermediate transfer member according to the present invention, the adjacent fibers 2 within the base layer 1 are disposed with a spacing of 50–3000 $\mu$m, preferably 100–2000 $\mu$m, further preferably 200–1800 $\mu$m. In case where the fiber spacing is below 50 $\mu$m, because of a substantial difference in resistivity between the fiber and the base layer, the electrical properties of the intermediate transfer member can be remarkably changed, so that good electrostatic transfer becomes difficult. On the other hand, if the fiber spacing is larger than 3000 $\mu$m, the resultant intermediate transfer belt is liable to be accompanied with noticeable surface waving, so that the resultant image is liable to be accompanied with an image density irregularity (core trace image) attributable to a surface unevenness on the intermediate transfer member.

Figure 5:
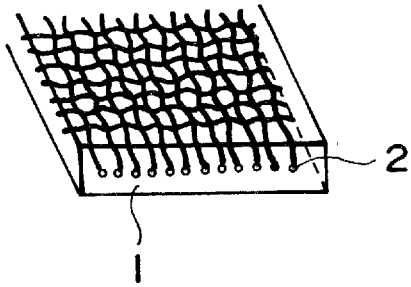

Also in the case of using a core member 1 in the form of a woven cloth as shown in FIG. 5, the fiber spacing should be 50–3000 $\mu$m, preferably 100–2000 $\mu$m, further preferably 200–1800 $\mu$m, both longitudinally and laterally.

Also in the case of using a core member in the form of parallelly arranged fiber rings, the fiber spacing should be 500–3000 $\mu$m, preferably 100–2000 $\mu$m, further preferably 200–1800 $\mu$m.

Figure 4:
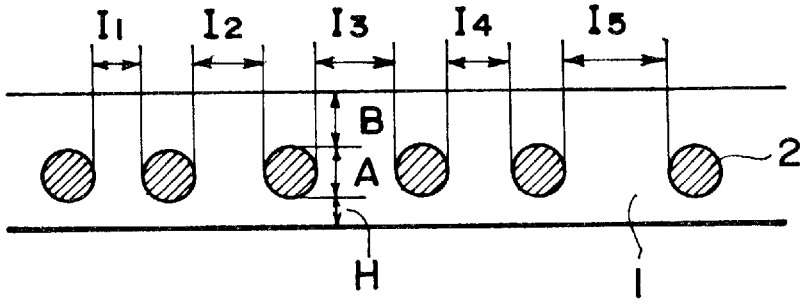
FIG. 4 is a sectional view showing an example of disposition of a core member within an intermediate transfer member according to the invention.

Herein, the fiber spacing between adjacent fibers is based on a value measured as an arithmetic mean of spacings $I_1$, $I_2$, $I_3$, $I_4$ and $I_5$ between arbitrarily selected adjacent 6 fibers (i.e., 5 spacings) as shown in FIG. 4. The 6 adjacent fibers should be selected in a region having the highest probability of carrying a toner image, i.e., in a region of ±5 cm from a center line C (i.e., totally 10 cm with the line C as a center line) shown in FIG. 1.

The core member can be composed of a plurality of superposed layers of woven cloths. In such a case, the woven cloth disposed closest to the outer surface (i.e., the surface for carrying a toner image) should have a fiber spacing in the range of 50–3000 $\mu$m.

Examples of the elastic material constituting the base layer 1 may include: natural rubber, isoprene rubber, styrene-butadiene rubber, butyl rubber, ethylene-propylene rubber, ethylene-propylene-diene terpolymer (EPDM), chloroprene rubber, chlorosulfonated polyethylene, chlorinated polyethylene, acrylonitrile-butadiene rubber, urethane rubber, syndiotactic 1,2-polybutadiene, epichlorohydrin rubber, acrylic rubber, silicone rubber, fluorine rubber, polysulfide rubber, polynorbonene rubber, hydrogenated nitrile rubber, thermoplastic elastomers (such as those of the polystyrene type, polyolefin type, polyvinyl chloride type, polyurethane type, polyamide type, polyester type, and fluorine-containing resin type); styrene resins (i.e., homopolymers and copolymers of styrene or substituted styrene) inclusive of polystyrene, poly-$\alpha$-methylstyrene, styrene-butadiene rubber, styrene-vinyl chloride copolymer, styrene-vinyl acetate-copolymer, styrene-maleic acid copolymer, styrene-acrylate copolymers (such as styrene-methyl acrylate copolymer, styrene-ethyl acrylate copolymer, styrene-butyl acrylate copolymer, styrene-octyl acrylate copolymer, and styrene-phenyl-acrylate copolymer), styrene-methacrylate copolymers (such as styrene-methyl methacrylate copolymer, styrene-ethyl methacrylate copolymer, and styrene-phenyl methacrylate copolymer), styrene-methyl $\alpha$-chloroacrylate copolymer, and styrene-acrylonitrile-acrylate copolymers, methyl methacrylate resin, butyl methacrylate resin, ethyl acrylate resin, butyl acrylate resin, modified acrylic resins (such as silicone-modified acrylic resin, vinyl chloride resin-modified acrylic resin and acrylic urethane resin), vinyl chloride resin, styrene-vinyl acetate copolymer, vinyl chloride-vinyl acetate copolymer, rosin-modified maleic acid resin, phenolic resin, epoxy resin, polyester resin, polyester-polyurethane resin, polyethylene, polypropylene, polybutadiene, polyvinylidene chloride, ionomer resin, polyurethane resin, silicone resin, fluorine-containing resin, ketone resin, ethylene-ethyl acrylate copolymer, xylene resin, polyvinyl butyral resin, polyamide resin, and modified polyphenylene oxide resin. These elastic materials may be used singly or in mixture of two or more species. The above are, however, not exhaustive.

The base layer 1 may preferably have a hardness (JIS-A hardness) of 10–95 deg., more preferably 20–80 deg., further preferably 25–70 deg., so as to obviate transfer failure, particularly hollow dropout image (i.e., a phenomenon that a central portion except for a contour is not sufficiently transferred). Accordingly, the base layer 1 may preferably comprise a rubber or elastomer or a soft resin among those enumerated above.

It is possible to add an electroconductivity-imparting additive in order to adjust the resistivity of the base layer 1. Examples of the conductivity-imparting agent may include: carbon black, powder of metal such as aluminum or nickel, metal oxide such as tin oxide or titanium oxide, and electroconductive polymers, such as quaternary ammonium salt-containing polymethyl methacrylate, polyvinylaniline, polyvinylpyrrole, polydiacetylene, polyethyleneimine, boron-containing polymers, and polypyrrole. These may be used singly or in combination of two or more species. These conductivity-imparting additives are not exhaustive. In the case of using a conductivity-imparting agent, it is preferred to add 5–40 wt. parts thereof per 100 wt. parts of the elastic material (rubber, elastomer or resin) of the base layer 1.

The base layer 1 may preferably have a thickness of 0.3–2 mm. Too large a thickness of the base layer 1 may result in difficulty in smooth drive. Too small a thickness may fail to provide a sufficient mechanical strength.

Examples of the fiber constituting the core member 2 may include: natural fibers of cotton, silk, hemp, and wool; reproduced fibers, such as chitin fiber, alginic acid, and reproduced cellulose fiber; semisynthetic fiber such as acetate fiber; synthetic fiber, such as polyester fiber, nylon fiber, acrylic fiber, polyolefin fiber, polyvinyl alcohol fiber, polyvinyl chloride fiber, polyvinylidene chloride fiber, polyurethane fiber, polyalkyl paraoxybenzoate fiber, polyacetal fiber, aramide fiber, polyfluoroethylene fiber, and phenolic resin fiber; inorganic fiber, such as carbon fiber, glass fiber and boron fiber; and metal fibers, such as iron fiber, and copper fiber. These fibers may be used singly or in combination of two or more species. The fiber may preferably have a thickness in diameter of 2–50 $\mu$m, more preferably 20–200 $\mu$m, further preferably 50–180 $\mu$m.

Too thin fiber thickness results in a low-mechanical strength of the intermediate transfer member, thus being liable to leave a problem regarding reliable durability. To thick fiber thickness is liable to result in noticeable core trace image.

The fiber thickness referred to herein is based on a value measured in the following manner.

<Fiber thickness measurement>

(1) An intermediate transfer member (belt) is cut in a thicknesswise direction, and the resultant section is enlarged to an appropriate magnification by appropriate means such as a microscope (FIG. 4).

(2) An appropriate fiber is selected, and a measured diameter (in case of fiber having a circular section) or a diameter of a circle providing sectional area equal to that of the fiber (in case of fiber having a non-circular section). In case of a yarn or thread composed of a plurality of filaments, the outer contour of the yarn or thread is used to determine the thickness.

The fiber used in the present invention may be in the form of a mono-filament or a thread or yarn composed of a twist or twined plurality of fibers. The manner of twisting may be any, including single twist, bias twist or double(-layered) twist. The direction of twist, i.e., left or right, is not questioned. It is also possible to use a thread or yarn of plural fiber species in mixture. The fiber can be used after an appropriate electroconductivity-imparting treatment, as desired.

In the present invention, the fibers are disposed to provide a spacing not exceeding 3000 $\mu$m between adjacent fibers. In addition, it is preferred to set a thickness B between the upper edge of the fiber and the upper surface of the intermediate transfer member relative to the diameter A of the fiber as shown in FIG. 4 so as to satisfy $B/A \geqq 1$, whereby the hardness irregularity and surface waving on the outer surface of the intermediate transfer member is further less noticeable.

Too large a B value is not desirable because it increases the rigidity of the intermediate transfer belt. Therefore, the value B may preferably be 2–1500 $\mu$m.

The values A, B and B/A are determined as arithmetic means of respective values measured with respect to arbitrarily selected five adjacent fibers.

Figure 6:
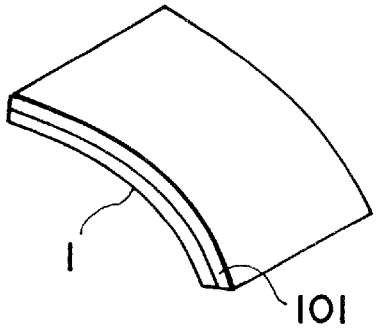
FIG. 6 is a partial perspective view showing an embodiment of the intermediate transfer member according to the invention having a coating layer.

The outer surface of the intermediate transfer member may preferably be provided with an increased releasability, e.g., by a surface treatment with bleaching powder or by providing a surface-coating layer 101 on the intermediate transfer member 1 as desired as shown in FIG. 6.

The coating layer 101 may be composed as a similar material as that of the base layer 1 as described above but may preferably exhibit a contact angle with water of at least 80 deg. For this purpose, the coating layer 101 may preferably contain a releasability-enhancing additive, such as silicone resin fine powder. The coating layer 101 may preferably have a thickness sufficiently small so as not to impair the resilience of the base layer, more specifically 1–500 $\mu$m, further preferably 5–200 $\mu$m. The coating layer 101 can also contain an electroconductivity-imparting additive similarly as in the base layer, e.g., in a proportion of 5–40 wt. parts per 100 wt. parts of the elastic material constituting the coating layer 101.

The core member 2 is preferably disposed at a depth within the base layer 1 so as to provide a spacing H from the inner surface (opposite to the outer surface for carrying a toner image) of the intermediate transfer member of at least 0.1 mm as shown in FIG. 6. A spacing H of below 0.1 mm is liable to cause severe fatigue of the outer surface layer, leading to cause cracks in the coating layer in some cases where such a coating layer is provided.

The reason for the severe fatigue of the outer surface layer of the intermediate transfer member in the case of the spacing H being smaller than 0.1 mm may be considered as follows.

Figure 7:
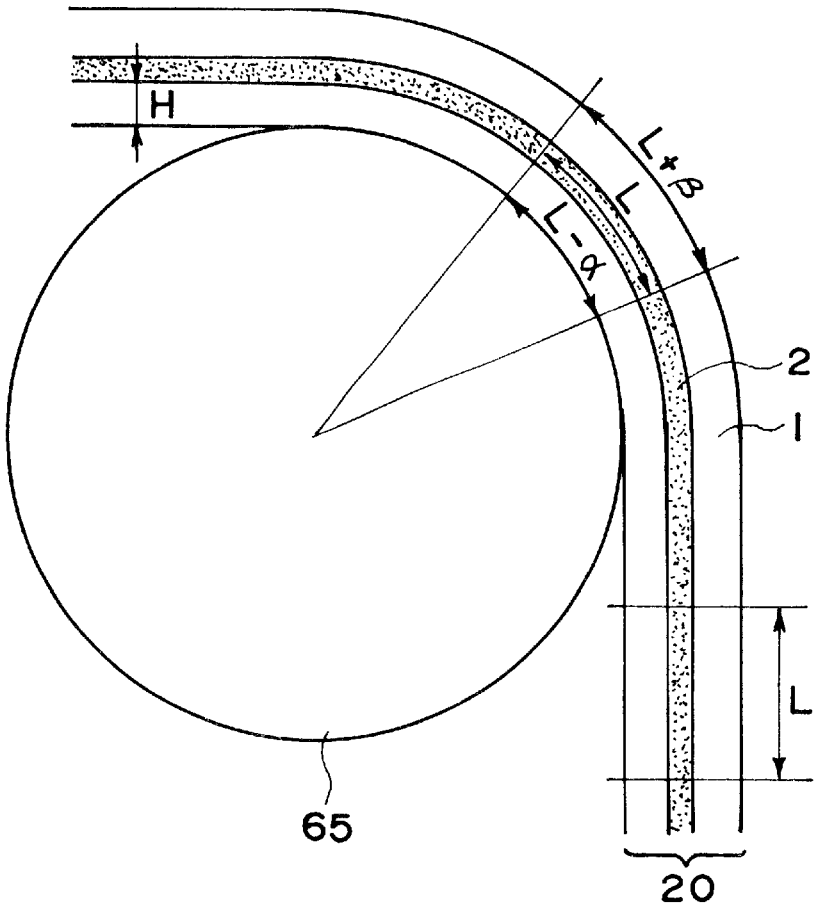
FIG. 7 is a partial side view for illustrating a relationship between an intermediate transfer member according to the invention and a roller.

As shown in FIG. 7, an appropriate portion of length L is taken along an intermediate transfer member 20. When the portion arrives at the position of a roller 65, an outer surface layer is elongated to a length $L+\beta$ and an inner surface layer is shrunk to $L-\alpha$ ($\alpha$, $\beta$: positive values), as the core member 1 is not substantially elongated or shrunk because of a larger tensile modulus than the base layer 1.

Thus, the outer surface layer of the intermediate transfer member 20 repetitively causes elongation-shrinkage at each passing of the roller 65, leading to severe fatigue of the outer surface layer of the intermediate transfer member.

Accordingly, in order to minimize the fatigue of the outer surface layer of the intermediate transfer member, it is preferred to minimize $\beta$, and this may be accomplished by increasing the spacing H between the core member 2 and the inner surface of the intermediate transfer member so as to have the core member 2 approach the outer surface.

The spacing H referred to herein is based on an arithmetic mean of measured values with respect to appropriately selected 5 adjacent fibers.

The intermediate transfer member according to the present invention may preferably be in the form of an endless belt or a tube which may preferably be seamless.

The intermediate transfer member according to the present invention may preferably have an electrical resistance across the thickness of $1\times10^4$ ohm to $1\times10^{11}$ ohm. Too high a resistance of the intermediate transfer member is liable to cause a lowering in transfer bias voltage within the intermediate transfer member, so that a first color toner image transferred already onto the intermediate transfer member is liable to return to the photosensitive member at the time of transfer of second or subsequent color toner image from the photosensitive member onto the intermediate transfer member, thus failing to provide a desired color image. On the other hand, too low a resistance of the intermediate transfer member results in a remarkable difference in resistance between a portion already carrying a transferred toner image and a portion not carrying a toner image, so that the effective transfer of second or subsequent color toner image can be obstructed to also fail in providing an objective color image.

The electrical resistance of the intermediate transfer member referred to herein is based on values measured in the following manner.

Figure 8:
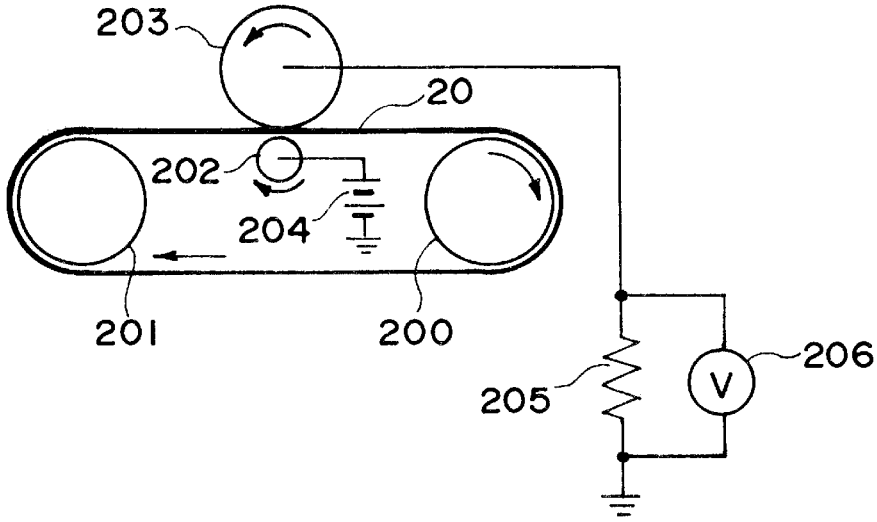
FIG. 8 is a side view for illustrating an apparatus for measuring an electric resistance of an intermediate transfer member according to the invention.

(1) An intermediate transfer member is wound under tension about a drive roller 200 and a driven metal roller 201, and the intermediate transfer member is sandwiched between two metal rollers 202 and 203 connected to a DC power supply 204, a resistor 205 having an appropriate resistance value $R_{205}$ and a potentiometer 206, as shown in FIG. 8.

(2) By operating the drive roller 200, the intermediate transfer member is moved at a surface velocity of 120 mm/sec.

(3) A voltage of 1 kV is applied from DC power supply 204 to read a potential difference Vr between both terminals of the resistor 205 by the potential meter 206. The measurement is made in an environment of a temperature of 23±5° C., and a moisture of 50±10% RH.

(4) A current I is calculated from the measured potential difference Vr as $I=Vr/R_{205}$.

(5) The resistance of the intermediate transfer member is calculated as applied voltage (1 kV)/current I.

The intermediate transfer member according to the present invention need not be produced through a particularly limited process but may be produced in the following manner. First of all, an elastic material is wound about a metal mold. Then, a core member is wound about the elastic material layer, and the core member is covered with a tubular-shaped elastic material. An adhesive may preferably be applied onto the core member in advance. Finally, the superposed elastic material layers are subjected to vulcanization, and the outer surface of the vulcanized product is abraded, whereby an intermediate transfer member holding a core member within a base layer is formed. An optional coating layer may be further provided, e.g., by spray coating, dip coating or electrostatic coating.

An electrophotographic apparatus will now be described with reference to FIG. 9.

The apparatus includes a rotating drum-type electrophotographic photosensitive member (hereinafter called "photosensitive drum") 1 repetitively used as a first image-bearing member, which is driven in rotation in a counterclockwise direction indicated by an arrow at a prescribed peripheral speed (process speed). The photosensitive drum 1 may preferably be one having an outermost layer containing fine powder of polytetrafluoroethylene resin (PTFE), so as to provide a high transfer efficiency, which may be attributable to an improved toner releasability caused by a lowering in surface energy of the outermost layer by inclusion of the PTFE fine powder.

During the rotation, the photosensitive drum 1 is uniformly charged to a prescribed polarity and potential by a primary charger 2 and then exposed to imagewise light 3 supplied from an imagewise exposure means (not shown, e.g., an optical system including means for color separation of a color original image, a scanning exposure system including a laser scanner for emitting laser beam modulated corresponding to time-serial electrical digital pixel signals of image data) to form an electrostatic latent image corresponding to a first color component image (e.g., a yellow color component image) of an objective color image.

Then, the electrostatic latent image is developed with a yellow toner Y (first color toner) by a first developing device (yellow developing device 41). At this time, second to fourth developing devices (magenta developing device 42, cyan developing device 43 and black developing device 44) are placed in an operation-off state and do not act on the photosensitive drum 1, so that the yellow (first color) toner image thus formed on the photosensitive drum 1 is not affected by the second to fourth developing devices.

An intermediate transfer member 20 is supported about rollers 64, 65 and 66 and rotated in a clockwise direction at a peripheral speed equal to that of the photosensitive drum 1.

As the yellow toner image formed and carried on the photosensitive drum 1 passes through a nip position between the photosensitive drum 1 and the intermediate transfer member 20, the yellow toner image is transferred onto an outer surface of the intermediate transfer member 20 under the action of an electric field caused by a primary transfer bias voltage applied from a primary transfer roller 62 to the intermediate transfer member 20 (primary transfer).

The surface of the photosensitive drum 1 after the transfer of the yellow (first color) toner image onto the intermediate transfer member 20 is cleaned by a cleaning device 13.

Thereafter, a magenta (second color) toner image, a cyan (third color) toner image and a black (fourth color) toner image are similarly formed on the photosensitive drum 1 and successively transferred in superposition onto the intermediate transfer member 20 to form a synthetic color toner image corresponding to an objective color image.

The transfer bias voltage for sequential transfer in superposition of the first to fourth color toner images from the photosensitive drum 1 onto the intermediate transfer member 20 is supplied in a polarity (+) opposite to that of the toner from a bias voltage supply 29. The voltage may preferably be in the range of, e.g., +100 volts to +2 kvolts.

For secondary transfer of the synthetic color toner image formed on the intermediate transfer member 20 onto a transfer-receiving material P (second image-bearing member), such as recording paper, a secondary transfer roller 63 is supported on a shaft in parallel to the roller (secondary transfer opposing roller) 64 and so as to be contactable onto a lower (but outer) surface of the intermediate transfer member 20. During the primary transfer steps for transferring the first to fourth color images from the photosensitive drum 1 onto the intermediate transfer member 20, the secondary transfer roller 63 can be separated from the intermediate transfer member 20.

For the secondary transfer, the secondary transfer roller 63 is abutted against the intermediate transfer member 20, a transfer-receiving material P is supplied via paper supply rollers 11 and a guide 10 to a nip position between the intermediate transfer member 20 and the secondary transfer roller 63 at a prescribed time and, in synchronism therewith, a secondary transfer bias voltage is applied to the secondary transfer roller 63 from a power supply 28. Under the action of the secondary transfer bias voltage, the synthetic color toner image on the intermediate transfer member 20 is transferred onto the transfer-receiving material (second image-bearing member) P (secondary transfer). The transfer-receiving material carrying the toner image is introduced into a fixing device to effect heat fixation of the toner image.

After completion of image transfer onto the transfer-receiving material P, a charging member 7 for cleaning connected to a bias voltage supply 26 is abutted to the intermediate transfer member 20 to apply a bias voltage of a polarity opposite to that of the photosensitive drum 1, whereby a transfer residual toner (a portion of toner remaining on the intermediate transfer member 20 without being transferred onto the transfer-receiving material P) is imparted with a charge of the opposite polarity. Then, the charged transfer residual toner is electrostatically transferred back to the photosensitive drum 1 at a nip position or a proximity thereto, whereby the intermediate transfer member 20 is cleaned.

Generally, the cleaning of the intermediate transfer member 20 may be performed by any cleaning means, such as blade cleaning, fur brush cleaning, electrostatic cleaning or a combination of these. However, in order to provide a small-sized an inexpensive apparatus, it is preferred to adopt the cleaning scheme as described with reference to FIG. 9, wherein the intermediate transfer member is cleaned by electrostatically transferring the transfer residual toner back to the photosensitive drum 1.

Figure 9:
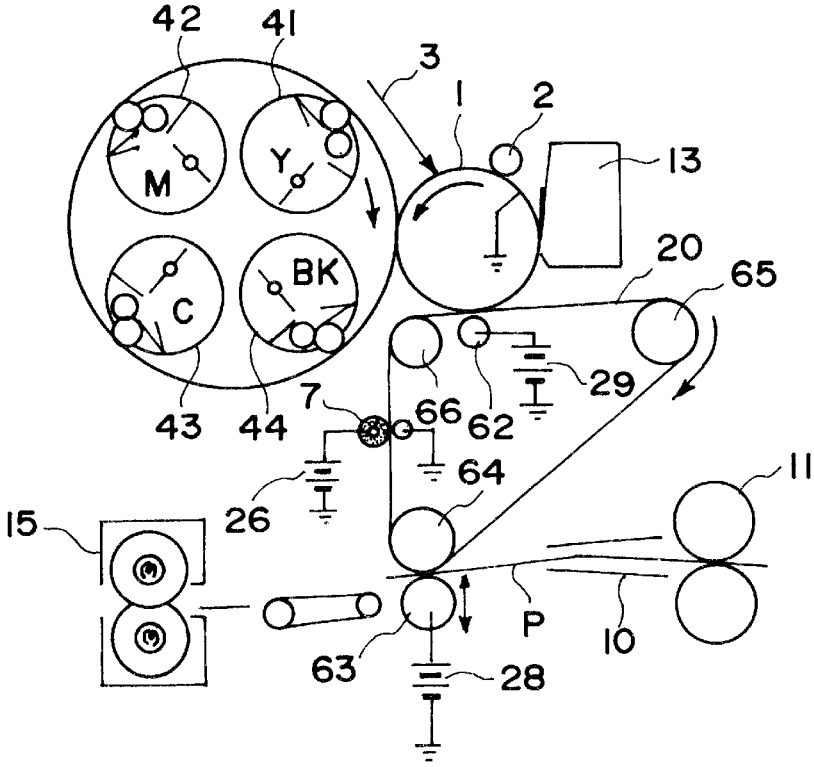
FIGS. 9 and 10 are side views each illustrating an electrophotographic apparatus according to the invention.

The charging member 7 for cleaning shown in FIG. 9 can assume a various form, such as a metal roller, an electroconductive elastic roller, an electroconductive fur brush, or an electroconductive blade.

In the image forming apparatus shown in FIG. 9, it is possible to adopt a cleaning scheme wherein a transfer residual toner on the intermediate transfer member 20 generated during a previous image forming step is transferred back to the photosensitive drum 1 simultaneously with the primary transfer of a toner image from the photosensitive drum 1 onto the intermediate transfer member 20 in a subsequent image forming step, which may be called a concurrent primary transfer-cleaning scheme"). The concurrent primary transfer-cleaning scheme is advantageous in that it is free from a lowering in throughput because of no additional cleaning step.

Figure 10:
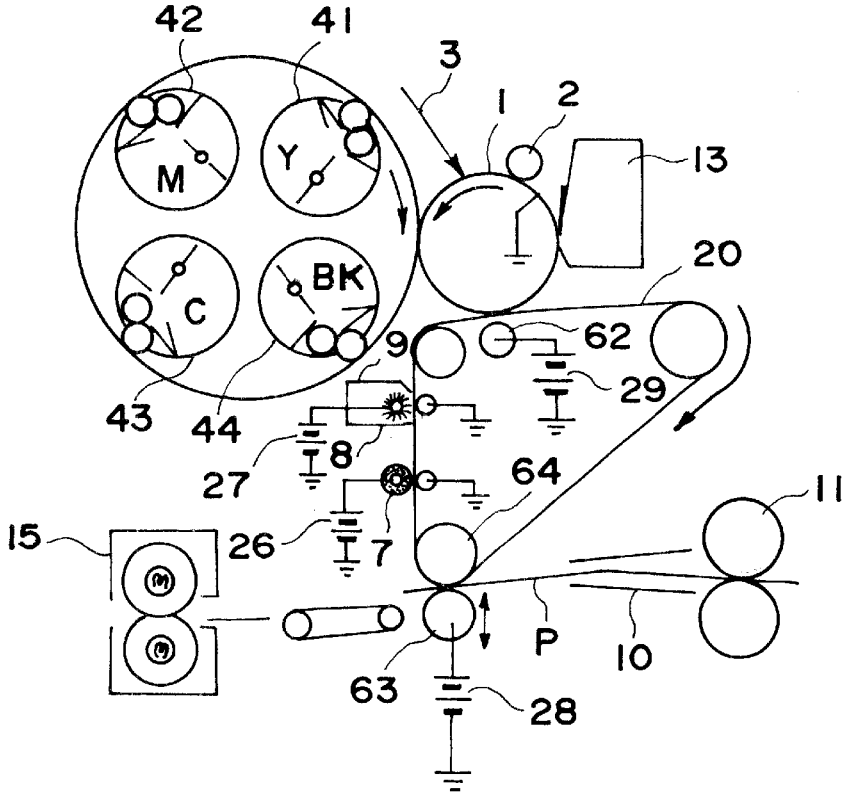

It is also possible to provide a transfer residual toner-recovering member 8 connected to a bias voltage supply as shown in FIG. 10.

The residual toner-recovering member 8 can also assume a various form, such as a metal roller, an electroconductive elastic roller, an electroconductive fur brush, or an electroconductive blade.

The residual toner-recovering member 8 may be supplied with a voltage of a polarity opposite to that applied to the charging member 7 for cleaning, thereby electrostatically cleaning the transfer residual toner.

Further, in the apparatus shown in FIG. 10, it is possible to apply a bias voltage of a polarity opposite to that of the photosensitive drum 1 to the residual toner-recovering member 8, thereby charging the transfer residual toner in a residual toner recovery vessel 9, so that the charged residual toner can be recovered by the cleaning device 13 for the photosensitive drum. This scheme is advantageous in that the residual toner-receiving vessel 9 can be reduced in size.

Figure 11:
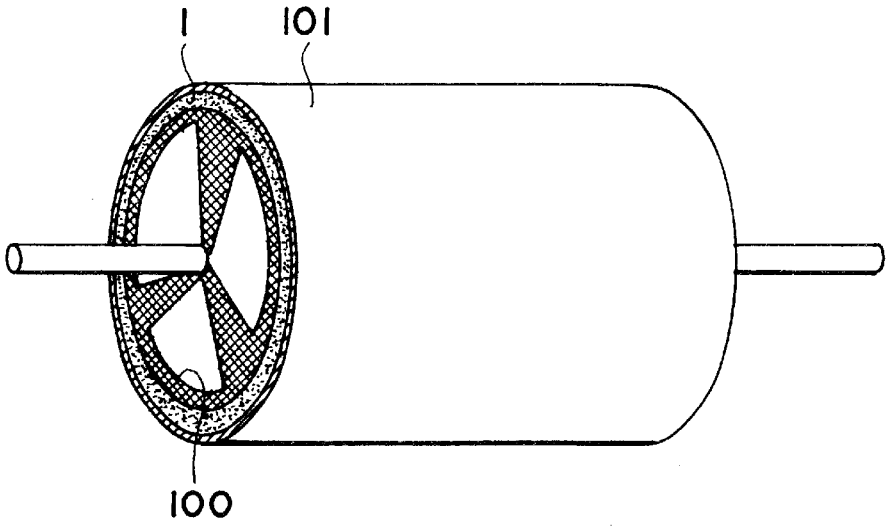
FIG. 11 is a perspective view of another embodiment of the intermediate transfer member according to the invention.

In the above, the intermediate transfer member according to the present invention has been described principally with reference to belt-shaped embodiments, but can also be a drum-shaped one as shown in FIG. 11. The intermediate transfer member shown in FIG. 11 comprises a cylindrical metal support 100 and a base layer 1 formed thereon including a core member (not specifically shown) embedded within the base layer 1. The base layer 1 can be covered with an optional coating layer 101 as described.

Hereinbelow, the present invention will be described more specifically based on Examples, wherein part(s) means part(s) by weight.

EXAMPLE 1

A rubber compound having a composition as shown below was wound about a cylindrical metal mold uniformly in a thickness of 0.4 mm. Then, a polyester twisted yarn (diameter=100 $\mu$m) coated with an adhesive was spirally wound about the rubber compound layer at a spacing of 0.05 mm (=50 $\mu$m) between adjacent yarns, and then further covered with a rubber compound of the composition shown below extruded in advance into a tube, followed by vulcanization and grinding to form a 0.8 mm-thick rubber belt of 250 mm in width and 435 mm in outer peripheral length reinforced with the polyester yarn as the core member.

| (Rubber compound) | |
|---|---|
| SBR rubber | 30 part(s) |
| EPDM rubber | 70 part(s) |
| Precipitated sulfur (vulcanizer) | 1.5 part(s) |
| Zinc white (vulcanization aid) | 2 part(s) |
| MBT (mercaptobenzothiazole) (vulcanization promoter) | 1.5 part(s) |
| TMTM (tetramethylthiuram monosulfide) (vulcanization promoter) | 1.2 part(s) |
| Carbon black (conductivity-imparting agent) | 25 part(s) |
| Stearic acid (dispersion aid) | 1 part(s) |
| Naphthenic process oil (plasticizer) | 40 part(s) |

The resultant belt was surface-treated with an aqueous solution containing bleaching powder to improve the surface releasability, thereby obtaining an intermediate transfer belt.

The intermediate transfer belt was incorporated in a full-color electrophotographic apparatus as shown in FIG. 9 and subjected to evaluation of color deviation, core trace image and transfer performance.

The cleaning of the intermediate transfer belt was performed by the concurrent primary transfer-cleaning scheme using an elastic roller having a resistance of $1\times10^8$ ohm as the cleaning member. The evaluation was performed by continuous printing of a full-color image on $1\times10^4$ sheets while supplying a current of +40 $\mu$A to the cleaning member 7 from the bias voltage supply 26. The other image forming conditions were as follows.

| | |
|---|---|
| Surface potential at non-image part: | −550 volts |
| Surface potential at image part: | −150 volts |
| Color developers (for all four colors): | non-magnetic monocomponent toner |
| Primary transfer voltage: | +500 volts |
| Secondary transfer voltage: | +1500 volts |
| Process speed: | 120 mm/sec |
| Developing bias voltage: | Vdc = −400 volts<br>Vac = 1600 Vpp<br>(f = 1800 Hz) |

As a result of evaluation, good electrostatic transfer was possible from the initial stage, and the resultant images were free from core trace image. It was possible to obtain good images free from color deviation attributable to permanent elongation of the belt. The results are inclusively shown in Table 2 appearing hereinafter together with those of other Examples.

EXAMPLES 2–6

Intermediate transfer belts were prepared in the same manner as in Example 1 except that the spacing between adjacent polyester yarns was changed as shown the following Table 1. The resultant intermediate transfer belts were evaluated in the same manner as in Example 1. The results are inclusively shown in Table 2.

TABLE 1

| | Ex. 2 | Ex. 3 | Ex. 4 | Ex. 5 | Ex. 6 |
|---|---|---|---|---|---|
| Spacing (mm) | 0.1 | 0.5 | 1.0 | 2.0 | 3.0 |

EXAMPLE 7

A solution of a rubber compound having a composition as shown below was applied onto a cylindrical metal mold to form a 0.07 μm-thick unvulcanized rubber layer. Then, a cotton yarn (diameter: 100 μm) coated with an adhesive was spirally wound about the rubber compound layer at a spacing of 0.70 mm (700 μm) between adjacent layers, and then further covered with a rubber compound of the composition shown below extruded in advance into a tube, followed by vulcanization and polishing to form a totally 1.2 mm-thick rubber belt of 250 mm in width and 435 mm in outer peripheral length reinforced with the cotton yarn as the core member.

| (Rubber compound) | |
|---|---|
| NBR rubber | 60 part(s) |
| EPDM rubber | 40 part(s) |
| Precipitated sulfur (vulcanizer) | 1.5 part(s) |
| Zinc white (vulcanization aid) | 2 part(s) |
| MBT (vulcanization promoter) | 1.5 part(s) |
| TMTM (vulcanization promoter) | 1.5 part(s) |
| Carbon black (conductivity-imparting agent) | 25 part(s) |
| Stearic acid (dispersion aid) | 1.2 part(s) |
| Naphthenic process oil (plasticizer) | 20 part(s) |

Then, the rubber belt was further coated with a surface layer paint of the following composition.

| (Surface layer paint) | |
|---|---|
| Polyurethane prepolymer | 100 parts |
| Isocyanate (hardener) | 4 parts |
| PTFE resin powder (average primary particle size of 0.3 μm) | 70 parts |
| Methyl ethyl ketone | 400 parts |
| N-methylpyrrolidone | 50 parts |

The above paint was sprayed onto the belt, dried to finger-felt dryness and then heated at 120° C. for two hours for complete drying and crosslinking of the paint to form an intermediate transfer belt having a 30 μm-thick tough surface coating layer (outermost layer).

The intermediate transfer belt was incorporated in a full-color electrophotographic apparatus as shown in FIG. 9 and subjected to evaluation of color deviation, core trace image and transfer performance in the same manner as in Example 1 except that an elastic layer having a resistance of $1\times10^7$ ohm was used as the cleaning member 7 and the continuous printing for evaluation was performed on $1.5\times10^4$ sheets so as to observe the fatigue of the surface coating layer.

As a result, good electrostatic transfer was effected from the initial stage and without any problem until $1\times10^4$ sheets. However, after $1.5\times10^4$ sheets of continuous image formation, no color deviation was observed. However, linear transfer failure portions were observed at some parts in a solid black image region due to some crack (observed later) in the surface coating layer. Such transfer failure was not noticeable in image regions other than those of solid black image. Thus, the transfer failure was at a practically acceptable level as a whole. The results are shown in Table 2 together with those of other Examples.

EXAMPLE 8

An intermediate transfer belt was prepared in the same manner as in Example 7 except that first an unvulcanized rubber layer was formed in a thickness of 0.1 mm on a cylindrical metal mold.

The resultant intermediate transfer belt was evaluated in the same manner as in Example 7. As a result, good electrostatic transfer was performed to provide good images free from core trace image. Even after continuous printing of full color images on $1.5\times10^4$ sheets, good images could be obtained without causing color deviation or occurrence of cracks in the coating layer. The results are also shown in Table 2.

EXAMPLE 9

A rubber compound having the same composition as in Example 7 was extruded into a 0.3 μm-thick tube, which was disposed to cover a cylindrical metal mold. Then, a cotton yarn (diameter: 100 μm) coated with an adhesive was spirally wound about the rubber compound layer at a spacing of 0.70 mm (700 μm) between adjacent layers, and then further covered with a rubber compound of the same composition extruded in advance into a tube, followed by vulcanization and grinding to form a totally 1.2 mm-thick rubber belt reinforced with the cotton yarn as the core member.

Then, a surface layer pain of the same composition as that used in Example 7 was sprayed onto the rubber belt, dried to finger-felt dryness and then heated at 120° C. for 2 hours for complete drying and crosslinking of the paint to obtain an intermediate transfer belt having a 30 μm-thick coating layer.

The resultant intermediate transfer belt was evaluated in the same manner as in Example 7. As a result, good electrostatic transfer was performed to provide good images free from core trace image. Even after continuous printing of full color images on $1.5\times10^4$ sheets, good images could be obtained without causing color deviation or occurrence of cracks in the coating layer. The results are also shown in Table 2.

EXAMPLE 10

An intermediate transfer belt was prepared in the same manner as in Example except that a rubber compound tube of 1.0 mm in thickness was first disposed to cover a metal mold, and the resultant intermediate transfer belt was evaluated in the same manner as in Example 7.

As a result, good electrostatic transfer was performed to provide good images free from core trace image. Even after continuous printing of full color images on $1.5\times10^4$ sheets, good images could be obtained without causing color deviation or occurrence of cracks in the coating layer. The results are also shown in Table 2.

EXAMPLE 11

A cylindrical metal mold was covered with a preliminarily extruded 0.6 mm-thick tube of a rubber compound having the same composition as in Example 7. Then, a polyester yarn (diameter=200 μm) was spirally wound about the rubber compound layer at a spacing of 1.0 mm between adjacent yarns, and then further covered with a preliminarily extruded tube of the same rubber compound, followed by vulcanization and polishing to form a 0.9 mm-thick reinforced rubber belt.

Then, the same surface layer paint as used in Example 7 was sprayed onto the rubber belt, dried to finger-felt dryness and then heated to 120° C. for 2 hours for complete drying and curing of the paint, to obtain an intermediate transfer belt having a 40 μm-thick coating layer.

The transfer belt exhibited a thickness B above the core member of 140 μm and thus a ratio B/A (core member thickness =200 μm) of 0.7.

The intermediate transfer belt was incorporated in a full-color electrophotographic apparatus as shown in FIG. 9 and evaluated in the same manner as in Example 1.

As a result, good electrostatic transfer was performed to provide good image free from color deviation from the initial stage, but slight core trace image within a practically acceptable extent was observed due to a B/A ratio below 1.

The results are also shown in Table 2.

EXAMPLE 12

A cylindrical metal mold was covered with a preliminarily extruded 0.6 mm-thick tube of a rubber compound having the same composition as in Example 7. Then, a polyester twisted yarn (diameter =140 μm) was spirally wound about the rubber compound layer at a spacing of 1.0 mm between adjacent yarns, and then further covered with a preliminarily extruded tube of the same rubber compound, followed by vulcanization and grinding to form a 0.8 mm-thick reinforced rubber belt.

Then, a 40 μm-thick coating layer was formed in the same manner as in Example 1 to obtain an intermediate transfer belt.

The transfer belt exhibited a thickness B above the core member of 140 μm and thus a ratio B/A (core member thickness=100 μm) of 1.0.

The intermediate transfer belt was incorporated in a full-color electrophotographic apparatus as shown in FIG. 9 and evaluated in the same manner as in Example 1.

As a result, good electrostatic transfer was performed to provide good image free from color deviation from the initial stage, and also free from core trace image.

EXAMPLE 13

A cylindrical metal mold was covered with a preliminarily extruded 0.6 mm-thick tube of a rubber compound having the same composition as in Example 7. Then, a polyester twisted yarn (diameter=100 μm) was spirally wound about the rubber compound layer at a spacing of 1.0 mm between adjacent yarns, and then further covered with a preliminarily extruded tube of the same rubber compound, followed by vulcanization and polishing to form a 1.0 mm-thick reinforced rubber belt.

Then, a 40 μm-thick coating layer was formed in the same manner as in Example 1 to obtain an intermediate transfer belt.

The transfer belt exhibited a thickness B above the core member of 340 μm and thus a ratio B/A (core member thickness=100 μm) of 3.4.

The intermediate transfer belt was incorporated in a full-color electrophotographic apparatus as shown in FIG. 9 and evaluated in the same manner as in Example 1.

As a result, good electrostatic transfer was performed to provide good image free from color deviation from the initial stage, and also free from core trace image.

EXAMPLE 14

A cylindrical metal mold was covered with a preliminarily extruded 0.4 mm-thick tube of a rubber compound having the same composition as in Example 7. Then, a polyester yarn (diameter=100 μm) was spirally wound about the rubber compound layer at a spacing of 1.0 mm between adjacent yarns, and then further covered with a preliminarily extruded tube of the same rubber compound, followed by vulcanization and grinding to form a 1.2 mm-thick reinforced rubber belt.

Then, a 40 μm-thick coating layer was formed in the same manner as in Example 1 to obtain an intermediate transfer belt.

The transfer belt exhibited a thickness B above the core member of 740 μm and thus a ratio B/A (core member thickness=100 μm) of 7.4.

The intermediate transfer belt was incorporated in a full-color electrophotographic apparatus as shown in FIG. 9 and evaluated in the same manner as in Example 1.

As a result, good electrostatic transfer was performed to provide good image free from color deviation from the initial stage, and also free from core trace image.

EXAMPLE 15

A cylindrical metal mold was covered with a preliminarily extruded 0.4 mm-thick tube of a rubber compound having the same composition as in Example 7. Then, a polyester twisted yarn (diameter=100 μm) was spirally wound about the rubber compound layer at a spacing of 1.0 mm between adjacent yarns, and then further covered with a preliminarily extruded tube of the same rubber compound, followed by vulcanization and polishing to form a 2.0 mm-thick reinforced rubber belt.

Then, a 40 μm-thick coating layer was formed in the same manner as in Example 1 to obtain an intermediate transfer belt.

The transfer belt exhibited a thickness B above the core member of 1540 μm and thus a ratio B/A (core member thickness=100 μm) of 15.4.

The intermediate transfer belt was incorporated in a full-color electrophotographic apparatus as shown in FIG. 9 and evaluated in the same manner as in Example 1.

As a result, good electrostatic transfer was performed to provide good image free from color deviation from the initial stage, and also free from core trace image.

Comparative Example 1

An intermediate transfer belt was prepared in the same manner as in Example 1 except that the polyester yarn was spirally wound at a spacing of 0.045 mm (45 μm).

The resultant intermediate transfer belt was incorporated in a full-color electrophotographic apparatus as shown in FIG. 9 and evaluated in the same manner as in Example 1.

As a result, the resultant images were free color deviation, but good electrostatic transferred could not be effected because the core fiber layer functioned like an insulating layer because of a small spacing of 0.045 mm between adjacent yarns.

The results are also shown in Table 1.

Comparative Example 2

An intermediate transfer belt was prepared in the same manner as in Example 1 except that the polyester yarn was spirally wound at a spacing of 3.5 mm (3500 μm).

The resultant intermediate transfer belt was incorporated in a full-color electrophotographic apparatus as shown in FIG. 9 and evaluated in the same manner as in Example 1.

As a result, the resultant images were free color deviation, but accompanied with core trace image because of a layer spacing of 3.5 mm between adjacent yarns.

Comparative Example 3

A cylindrical metal mold was covered with a preliminarily extruded tube of a rubber compound having the same composition as in Example 1, followed by vulcanization and grinding to form 1.0 mm-thick rubber belt.

Then, the rubber belt was surface-treated with an aqueous solution containing bleaching powder to improve the surface releasability to obtain an intermediate transfer belt.

The intermediate transfer belt was incorporated in a full-color electrophotographic apparatus as shown in FIG. 9 and evaluated in the same manner as in Example 1.

As a result, the resultant images were free from core trace images (as a matter of course because the transfer belt contained no core member) but were accompanied with noticeable color deviation, thus failing to provide practically acceptable full color image.

The results of the above Examples and Comparative Examples are inclusively shown in the following Table 2.

TABLE 2

| | Color deviation | Core trace image | Transfer failure | Cracks after $1.5 \times 10^4$ sheets |
|---|---|---|---|---|
| Ex. 1 | A | A | A | — |
| Ex. 2 | A | A | A | — |
| Ex. 3 | A | A | A | — |
| Ex. 4 | A | A | A | — |
| Ex. 5 | A | A | A | — |
| Ex. 6 | A | A | A | — |
| Ex. 7 | A | A | A | B3 |
| Ex. 8 | A | A | A | A |
| Ex. 9 | A | A | A | A |
| Ex. 10 | A | A | A | A |
| Ex. 11 | A | B2 | A | — |
| Ex. 12 | A | A | A | — |
| Ex. 13 | A | A | A | — |
| Ex. 14 | A | A | A | — |
| Ex. 15 | A | A | A | — |
| Comp. Ex. 1 | A | A | C3 | — |
| Comp. Ex. 2 | A | C2 | A | — |
| Comp. Ex. 3 | C1 | A | A | — |

The evaluation in the above table was performed according to the following standards:
A: Not occurred.
B (B2, B3): Occurred but at a practically acceptable level.
B2: Core trace image was not noticeable at a glance but noticeable by careful observation.
B3: Some linear transfer portions attributable to cracks in the surface coating layer were observed in a solid black image region at a practically acceptable level.
C (C1, C2, C3): Occurred at a practically unacceptable level.
C1: Deviation of respective colors occurred at a level of 300 μm or larger.
C2: Core trace image was clearly observed.
C3: Objective colors could not be obtained due to poor transfer efficiency of the respective colors.

What is claimed is:

1. An electrophotographic intermediate transfer member having an outer surface for carrying a toner image thereon, exhibiting an electrical resistance of $1\times10^4$–$1\times10^{11}\Omega$, comprising:

a base layer comprising an elastic material and an electroconductivity-imparting additive; and non-conductive fibers embedded in the base layer and each having a diameter of 100–200 μm, wherein the fibers are disposed with a spacing of 50–3000 μm, wherein a fiber diameter "A" and a distance between an upper edge of the fiber and an outer surface of the intermediate transfer member "B" satisfies the following relation:

$$B/A \geqq 1,$$

and wherein the base layer has a treated-surface constituting the outer surface of the intermediate transfer member, or has a coating-layer of a thickness of 1 to 500 μm on the base layer, the surface of the coating layer constituting the outer surface of the intermediate transfer member.

2. An intermediate transfer member according to claim 1, wherein the fibers are disposed at a spacing of 100–2000 μm between adjacent fibers.

3. An intermediate transfer member according to claim 1, wherein the fibers are disposed at a spacing of 200–1800 μm between adjacent fibers.

4. An intermediate transfer member according to claim 1, wherein said base layer comprises spirally wound fibers.

5. An intermediate transfer member according to claim 1, wherein said base layer comprises fibers in the form of a woven cloth.

6. An intermediate transfer member according to claim 1, wherein said base layer comprises fiber rings disposed in parallel.

7. An intermediate transfer member according to claim 1, wherein the surface of the coating layer exhibits a contact angle with water of at least 80 deg.

8. An intermediate transfer member according to claim 1, wherein the distance between a lower edge of the fiber and the surface of said intermediate transfer member opposite to the outer surface, is not less than 0.1 mm.

9. An electrophotographic apparatus, comprising:

an electrophotographic photosensitive member;

charging means for charging the electrophotographic photosensitive member;

imagewise exposure means for exposing imagewise the charged electrophotographic photosensitive member to form an electrostatic image;

developing means for developing the electrostatic image to form a toner image on the electrophotographic photosensitive member;

an electrophotographic intermediate transfer member disposed so that a toner image on the electrophotographic photosensitive member is transferred thereto, and so that a toner image thereon is transferred to a transfer-receiving material, a first power supply for applying a transfer bias to the intermediate member at a site where the toner image on the electrophotosensitive member is transferred to the intermediate transfer member; and a second power supply for applying a transfer bias to the transfer-receiving material at a site where the toner image on the intermediate transfer member to the transfer-receiving material, wherein said intermediate transfer member is that according to claim 1.

10. An apparatus according to claim 9, wherein said toner image comprises a plurality of superposed toner images having mutually different colors.

11. An apparatus according to claim 9, wherein said electrophotographic photosensitive member has an outermost layer comprising tetrafluoroethylene resin.

12. An apparatus according to claim 9, further including a cleaning means for charging a portion of toner remaining on the intermediate transfer member without being transferred and electrically recovering the charged portion of toner.

13. An electrophotographic intermediate transfer member having an outer surface to which a toner image is transferred from an electrophotographic photosensitive member under application of a transfer bias, and from which a transferred toner image thereon is transferred to a transfer-receiving material under application of a transfer bias, exhibiting an electrical resistance of $1\times10^{4}$–$1\times10^{11}\Omega$, the intermediate transfer member comprises:

a base layer comprising an elastic material and an electroconductivity-imparting additive; and non-conductive fibers embedded in the base layer and having a diameter of 100–200 $\mu$m, wherein the fibers are disposed with a spacing of 50–3000 $\mu$m, wherein a fiber diameter "A" and a distance between an upper edge of the fiber and an outer surface of the intermediate transfer member "B" satisfies the following relation:

$$B/A \geqq 1$$

and wherein the base layer has a treated-surface constituting an outer surface of the intermediate transfer member, or has a coating-layer of a thickness of 1 to 500 $\mu$m on the base layer, the surface of the coating layer constituting the outer surface of the intermediate transfer member.

* * * * *

UNITED STATES PATENT AND TRADEMARK OFFICE

CERTIFICATE OF CORRECTION

PATENT NO. : 6,704,535 B2
DATED : March 9, 2004
INVENTOR(S) : Hiroyuki Kobayashi et al.

It is certified that error appears in the above-identified patent and that said Letters Patent is hereby corrected as shown below:

Title page,
Item [56], References Cited, FOREIGN PATENT DOCUMENTS, "62293270" should read -- 62-293270 --; "63301960" should read -- 63-301960 --; "03069166" should read -- 3-69166 --; "JP 03293385 12/1991" should be deleted; and "06149079" should read -- 6-149079 --.

Column 1,
Line 25, "glipper" should read -- gripper --.

Column 2,
Line 53, "comprising" should read -- comprises --.

Column 5,
Line 38, "To" should read -- Too --.

Column 9,
Line 23, "an" should read -- and --.

Column 12,
Line 44, "pain" should read -- paint --.

Column 14,
Line 65, "free" should read -- free from --.

Column 15,
Line 11, "free" should read -- free from --.
Line 28, "image." should read -- images. --.

Signed and Sealed this

Fourteenth Day of December, 2004

JON W. DUDAS
*Director of the United States Patent and Trademark Office*